United States Patent [19]

Söhner et al.

[11] Patent Number: 4,928,660

[45] Date of Patent: May 29, 1990

[54] PROTECTIVE CASE FOR COMBINATION IGNITION COIL AND ELECTRONIC CONTROL

[75] Inventors: Gerhard Söhner, Geradstetten; Helmut Roth, Schwieberdingen; Hartmut Brammer, Vaihingen; Richard Schleupen, Grossingersheim; Karl-Heinz Nübel, Schwieberdingen, all of Fed. Rep. of Germany

[73] Assignee: Robert Bosch GmbH, Stuttgart, Fed. Rep. of Germany

[21] Appl. No.: 327,816

[22] Filed: Mar. 23, 1989

[30] Foreign Application Priority Data

Apr. 2, 1988 [DE] Fed. Rep. of Germany ..... 3811216

[51] Int. Cl.[5] ..... F02P 15/00

[52] U.S. Cl. ..... 123/647; 123/635

[58] Field of Search ..... 123/647, 635

[56] References Cited

U.S. PATENT DOCUMENTS

| | | | |
|---|---|---|---|
| 2,462,491 | 2/1949 | Hallett | 123/647 |
| 3,902,471 | 9/1975 | Brungsberg | 123/635 |
| 4,195,611 | 4/1980 | Wörz et al. | 123/647 |
| 4,198,943 | 4/1980 | Wörz | 123/647 |
| 4,248,201 | 2/1981 | Tsutsui et al. | 123/647 |
| 4,499,888 | 2/1985 | Hino et al. | 123/647 |
| 4,665,922 | 5/1987 | Gillbrand | 123/647 |
| 4,671,248 | 6/1987 | Gillbrand | 123/647 |

FOREIGN PATENT DOCUMENTS

| | | | |
|---|---|---|---|
| 0075263 | 3/1983 | European Pat. Off. . | |
| 0245761 | 11/1987 | European Pat. Off. . | |
| 1803495 | 7/1980 | Fed. Rep. of Germany . | |
| 1534024 | 7/1968 | France . | |
| 0093969 | 5/1984 | Japan | 123/647 |

OTHER PUBLICATIONS

Konishi/ Nippon Denso, Pat. Abs. of Japan Apr. 6, 1985, vol. 9, No. 77 (M-369)(1800)=59-208166.

Kasufuchi/Hitachi, Patent Abstracts of Japan Jul. 26, 1983, vol. 7, No. 169 (M-231)(13/4)=58-74873.

*Primary Examiner*—Tony M. Argenbright

*Assistant Examiner*—Robert Mates

*Attorney, Agent, or Firm*—Frishauf, Holtz, Goodman & Woodward

[57] ABSTRACT

A protective case (13) for a vehicle ignition system covers both the ignition coil (5), an electronic control device (6), and the terminals (11) and connecting conductors (12) therebetween. The preferred material is plastic, with an electromagnetically conducting coating for screening against incoming and outing electromagnetic noise. Thus, protection is provided against mechanical, chemical, and electromagnetic environmental influences. The case is dimensioned to snap over and seal respective edges of the electronic control device (6), the ignition coil (5) and its core (8), the electrical terminals (11), and the interconnecting conductors (12). The case is bifurcated along an access slit (16) which is secured in a normally closed position by knob (15) which press-fits into a mating hole on the other side of the slit. Two sides of the case have curved ridges or dimples which provide flexibility to hinge the case open for insertion of the ignition coil (5) and electronic control device (6).

8 Claims, 1 Drawing Sheet

PROTECTIVE CASE FOR COMBINATION IGNITION COIL AND ELECTRONIC CONTROL

Cross-reference to related patent, assigned to the assignee of the present invention, the disclosure of which is incorporated by reference herein: U.S. Pat. No. 4,198,943, WÖRZ, Apr. 22, 1980.

The present invention relates generally to protective cases for ignition coils and, more particularly, to cases which can accomodate not only the ignition coil, but also electronic control devices.

BACKGROUND

German Patent Disclosure DE-OS No. 27 20 065 and corresponding U.S. Pat. No. 4,198,943, WÖ RZ, disclose a combination ignition coil and electronic control which are located in a common housing with cover, which is relatively complicated and expensive to manufacture. The structure of the cover is such that assembly and disassembly require a lot of time. Further, supplemental seals are required. If there is a defect in the ignition coil or a single one of the electronic components, the entire unit must sometimes be scrapped and replaced.

THE INVENTION

It is an object of the present invention to simplify the housing structure for receiving the ignition coil and electronics unit and to facilitate assembly and obviate the need for assembly tools.

Briefly, this is achieved by molding or otherwise forming the housing in a shape which conforms to the outer contours of the ignition coil and electronic control unit, and thus secures them in a defined position therewithin. By providing snap-fits over the edges of the protected components, the need for separate seals is obviated. This provides mechanical and chemical protection for the components inside.

Further, providing an electrically or magnetically conducting coating on the surface of the protective case results in effective screening against environmental influences and against incoming or outgoing electromagnetic emissions. This coating may be applied by any of several standard methods.

DRAWINGS

These and other significant features of the present invention will be apparent from the following description and drawings, of which:

FIG. 1 is a longitudinal cross-section through the protective case of the present invention, showing the ignition coil and electronics unit inside; and FIG. 2 is a sectional view from above, sectioned along line II—II of FIG. 1.

DETAILED DESCRIPTION

Figure 1:
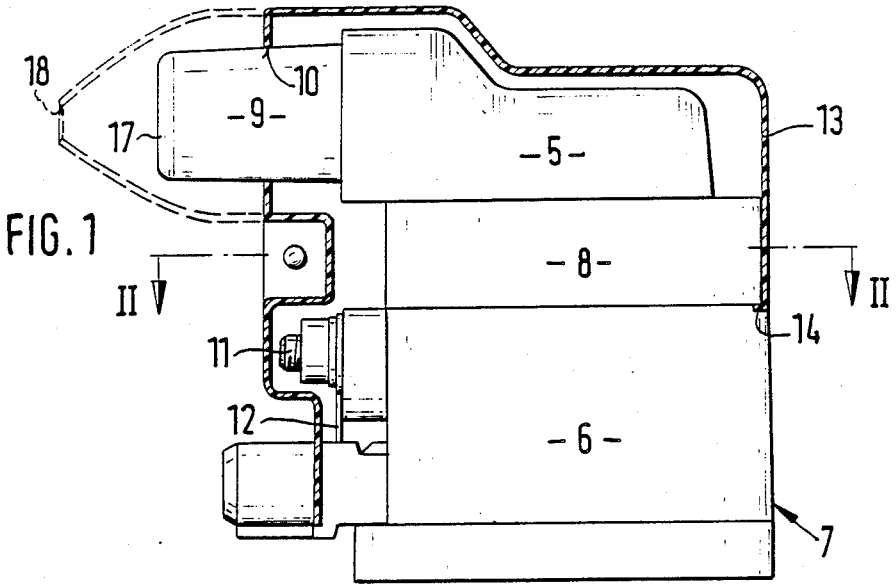

FIG. 1 illustrates a structural unit 7 comprising an ignition coil 5 and an electronic device 6. One can recognize a coil core 8 of ignition coil 5, a high voltage terminal 9, the mating high voltage cup terminal or dome 17 for connection to a high voltage cable (not shown) which may be of standard construction, the electrical terminals 11 of the primary winding of ignition coil 5, and the covered conductive tracks 12.

Protective case 13, which is preferably of an elastic plastic, engages with an inwardly protruding flange 14 onto an adjacent portion of coil core 8, and can therefore be easily latched on and just as easily taken off again. Case 13 is formed with an aperture 10 whose edge hugs high voltage terminal 17.

Figure 2:
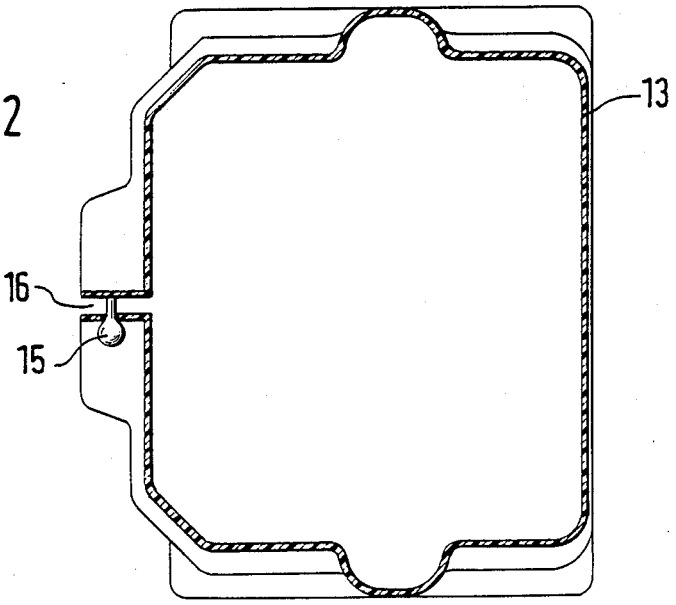

As shown in FIG. 2, at the level of plane II—II, case 13 is preferably continuous except for a vertical slit 16, at which the case is formed with a pair of outwardly extending parallel flanges. One flange is formed with a knob 15 which extends horizontally toward the other flange, and can be press-fitted through a hole in that other flange, to thereby secure the case together. Case 13 has a substantially rectangular cross-section. Taking the slit side as the front, and the opposing, essentially flat, side as the back, the remaining two sides are formed with dimples or ridges which facilitate flexing or hinging of the plastic case for the purpose of opening and closing the case at slit 16.

Protective case 13 seals off from the environment electrical connections 11 between electronic control unit 6, ignition coil 5, the voltage-supplying conductive tracks 12, which may, for example, carry rectified direct current across a printed circuit board, and seals off coil core 8. As previously noted, a portion of case 13 is formed with a slit 16 which is preferably held shut with a press-fitted knob 15.

Referring back to FIG. 1, case 13 can be formed with an essentially conical extension, as shown in phantom, which has an aperture 18 at the point of the cone for passage of the high voltage cable (not shown) discussed above. This alternate embodiment has the advantage of helping to align the cable and keep it from being pulled sideways off terminals 9, 17.

Various changes are possible within the scope of the inventive concept, and features of one embodiment may be combined with features of another embodiment.

We claim:

1. An elastic protective case for a vehicle ignition system having an ignition coil and an electronic control device, comprising, in accordance with the invention, an integrally formed enclosure (13) defining a portion shaped to receive and secure said ignition coil (5); a portion shaped to receive and secure said electronic control device (6), said portions defining therebetween a space for electrical terminals (11) and conductors (12) interconnecting said coil (5) and said electronic control device.

2. A protective case according to claim 1, further comprising electromagnetic screening means provided on said enclosure (13), thereby intercepting electromagnetic noise propagating to and from said ignition coil (5) and said control device (6).

3. A protective case according to claim 1, wherein said integrally formed enclosure is formed with an access slit (16) to the interior thereof and means (15) for securing said access slit in a normally-closed configuration.

4. A protective case according to claim 1, wherein said case is formed with a portion (14) which engages over protected components therewithin by reason of elasticity of said case.

5. A protective case according to claim 4, wherein said portion which engages is an inwardly protruding flange (14) which, selectively, grips or releases an edge of a protected unit (7).

6. A protective case according to claim 1, wherein opposing sides of said case are formed with longitudinal ridges or dimples to facilitate flexing open of said case along an access slit (16).

7. A protective case according to claim 1, further comprising a conical extension formed in said case adjacent a high voltage terminal (17) of said ignition coil (5).

8. A vehicle ignition system comprising, in combination:

an ignition coil (5);

an electronic control device (6);

electrical terminals (11) and conductors (12) interconnecting said coil (5) and said electronic control device (6); and an elastic protective case (13) at least partially enclosing, and having respective portions interfitting with and securing, said coil and said control device in predetermined orientations with respect to said case and to each other.

* * * * *